US011810530B2

(12) United States Patent
Hu et al.

(10) Patent No.: US 11,810,530 B2
(45) Date of Patent: Nov. 7, 2023

(54) METHOD FOR DISPLAY-BRIGHTNESS ADJUSTMENT AND RELATED DEVICES

(71) Applicant: GUANGDONG OPPO MOBILE TELECOMMUNICATIONS CORP., LTD., Guangdong (CN)

(72) Inventors: Jie Hu, Guangdong (CN); Zhiqing Yao, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 176 days.

(21) Appl. No.: 17/477,488

(22) Filed: Sep. 16, 2021

(65) Prior Publication Data

US 2022/0005440 A1 Jan. 6, 2022

Related U.S. Application Data

(63) Continuation of application No. PCT/CN2020/079007, filed on Mar. 12, 2020.

(30) Foreign Application Priority Data

Apr. 2, 2019 (CN) ..... 201910263510.0

(51) Int. Cl.

*G09G 5/10* (2006.01)
*G09G 5/377* (2006.01)
*G09G 5/02* (2006.01)

(52) U.S. Cl.

CPC ..... *G09G 5/10* (2013.01); *G09G 5/026* (2013.01); *G09G 2320/062* (2013.01)

(58) Field of Classification Search

CPC .. G09G 3/34; G09G 3/36; G09G 5/00; G09G 5/02; G09G 5/04; G09G 5/06; G09G 5/10;

(Continued)

(56) References Cited

U.S. PATENT DOCUMENTS

2005/0143654 A1* 6/2005 Zuiderveld ..... G06T 15/08 600/443
2010/0053441 A1* 3/2010 Tokashiki ..... H04N 5/208 348/576

(Continued)

FOREIGN PATENT DOCUMENTS

CN 103914314 A 7/2014
CN 104078028 A 10/2014

(Continued)

OTHER PUBLICATIONS

International search report with English Translation issued in corresponding PCT/CN2020/079007 dated May 27, 2020.

(Continued)

*Primary Examiner* — Chanh D Nguyen
*Assistant Examiner* — Nguyen H Truong
(74) *Attorney, Agent, or Firm* — Young Basile Hanlon & MacFarlane, P.C.

(57) ABSTRACT

A method for display-brightness adjustment and related products is for an electronic device. The electronic device includes a screen and a distributed processing unit (DPU), the DPU includes hardware of N layers and a layer mix, and the hardware of N layers includes hardware of a first layer and hardware of M second layer, N being an integer greater than 1, M<N, and each of the hardware of N layers being coupled with the layer mix. The method includes the following. Backlight brightness of the screen is set to a first threshold in response to detecting an adjustment instruction for the backlight brightness of the screen. The first layer is modified to decrease brightness of the first layer. A third layer is obtained by superimposing a modified first layer and multiple second layer. Display the third layer on the screen.

18 Claims, 4 Drawing Sheets

(58) Field of Classification Search
CPC ..... G09G 5/026; G09G 5/36; G09G 5/30; G09G 5/377; G09G 5/397; G09G 2320/062; G01C 21/00; G01C 21/32; G01C 21/36; G06F 16/23; G06F 3/048; G06F 3/0482; G06F 3/0483; G06F 3/0485; G06F 3/0488; G06T 1/00; G06T 5/00; G06T 5/50; G06T 7/20; G06T 7/90; G06T 7/254; G06T 13/80; B60K 35/00; B60K 37/02; B60R 1/00; B62D 1/04; B60Q 1/00; G60K 9/36
See application file for complete search history.

(56) References Cited

U.S. PATENT DOCUMENTS

| | | | | |
|---|---|---|---|---|
| 2014/0328548 | A1 | 11/2014 | Carpenter et al. | |
| 2015/0294627 | A1 | 10/2015 | Yoo et al. | |
| 2017/0113612 | A1* | 4/2017 | Taguchi | B60R 1/00 |
| 2017/0154605 | A1 | 6/2017 | Kajita et al. | |
| 2018/0047347 | A1 | 2/2018 | Brush et al. | |
| 2018/0247613 | A1 | 8/2018 | Lee et al. | |
| 2020/0242737 | A1* | 7/2020 | Stan | G06T 5/001 |

FOREIGN PATENT DOCUMENTS

| | | | |
|---|---|---|---|
| CN | 105487893 | A | 4/2016 |
| CN | 107123399 | A | 9/2017 |
| CN | 108389552 | A | 8/2018 |
| CN | 108510962 | A | 9/2018 |
| CN | 108646969 | A | 10/2018 |
| CN | 109343811 | A | 2/2019 |
| CN | 109389564 | A | 2/2019 |
| CN | 109523506 | A | 3/2019 |
| CN | 109542376 | A | 3/2019 |

OTHER PUBLICATIONS

China First Office Action with English Translation issued in corresponding CN application No. 201910263510.0 dated Jun. 1, 2020.
China Notice of Allowance with English Translation issued in corresponding CN application No. 201910263510.0 dated Dec. 23, 2020.
Extended European Search Report for EP Application 20784954.8 dated Jul. 8, 2022. (17 pages).
Communication pursuant to Rule 164(1) EPC for EP Application 20784954.8 dated Apr. 7, 2022. (18 pages).

* cited by examiner

METHOD FOR DISPLAY-BRIGHTNESS ADJUSTMENT AND RELATED DEVICES

CROSS-REFERENCE TO RELATED APPLICATION(S)

This application is a continuation of International Application No. PCT/CN2020/079007, filed on Mar. 12, 2020, which claims priority to Chinese Patent Application No. 2019102635100, filed on Apr. 2, 2019, the entire disclosures of both of which are incorporated herein by reference.

TECHNICAL FIELD

This disclosure relates to the technical filed of electronics, and particularly to a method for display-brightness adjustment and related products.

BACKGROUND

At present, the way of adjusting a gray level of a screen in an interval of 0 to 256 is different from that of adjusting in an interval of 257 to 1024. Adjustment in the interval of 257 to 1024 is to adjust a voltage, and adjustment in the interval of 0 to 256 is to adjust a duty cycle of power supply. Currently, screen flickering occurs, because a frequency band set during adjusting the duty cycle of the power supply is 480 Hz, which is in a low frequency band and can be easily perceived by a user.

SUMMARY

Disclosed herein are implementations of a method for display-brightness adjustment and related products.

In a first aspect, a method for display-brightness adjustment is provided. The method is for (i.e., applicable to or performed by) an electronic device. The electronic device includes a screen and a distributed processing unit (DPU), the DPU includes hardware of N layers (i.e., N layer-hardware units) and a layer mix, and the hardware of N layers includes hardware of a first layer and hardware of M second layer, N being an integer greater than 1, M<N, each of the hardware of N layers being coupled with the layer mix. The method includes the following.

Backlight brightness of the screen is set to a first threshold in response to detecting an adjustment instruction for the backlight brightness of the screen, where the adjustment instruction is indicative of adjusting the backlight brightness of the screen to a first backlight brightness, the first backlight brightness being less than the first threshold. A layer parameter of the first layer is modified and a new first layer is recreated based on the modified layer parameter of the first layer to cover the first layer, where the layer parameter of the first layer includes at least one of: a size, a transparency, or a RGB value, where a modified RGB value is a constant and less than the RGB value before modification, and a modified transparency is greater than the transparency before modification. Information of the first layer and information of the M second layer are received through the layer mix and a third layer is obtained by performing layer superimposing based on the information of the first layer and the information of the M second layer through the layer mix, where the information of first layer is transmitted through the hardware of the first layer, and the information of the M second layer is transmitted through the hardware of the M second layer. Information of the third layer is received through the screen and layer display is performed through the screen based on the information of the third layer, the information of the third layer being transmitted through the layer mix.

According to a second aspect, implementations provide an electronic device. The electronic device includes a screen, an application processor (AP), a memory, a communication interface, and one or more programs stored in the memory, the AP including a distributed processing unit (DPU), the DPU including hardware of N layers and a layer mix, the hardware of N layers including hardware of a first layer and hardware of M second layer, N being an integer greater than 1, M<N, each of the hardware of N layers being coupled with the layer mix. The one or more programs are configured to be executed by the AP and include instructions configured to perform all or part of operations of the method in the first aspect.

According to a third aspect, implementations provide a non-transitory computer-readable storage medium. The non-transitory computer-readable storage medium is configured to store a computer program for electronic data interchange. The computer program causes a computer to execute all or part of operations of the method in the first aspect.

BRIEF DESCRIPTION OF DRAWINGS

To describe technical solutions in implementations of the present disclosure more clearly, the following briefly introduces accompanying drawings required for illustrating the implementations. Apparently, the accompanying drawings in the following description illustrate some implementations of the present disclosure. Those of ordinary skill in the art may also obtain other drawings based on these accompanying drawings without creative efforts.

DETAILED DESCRIPTION

The following will describe implementations of the present disclosure in detail.

An electronic device described herein may include various handheld devices, in-vehicle devices, wearable devices, computing devices that have wireless communication functions or other processing devices connected to the wireless modem, as well as various forms of user equipment (UE), mobile stations (MS), terminal devices, and the like.

It is to be noted that, the term "hardware" used herein should be understood as the broadest meaning as possible, and an object for implementing functions defined by each "hardware" may be, for example, an integrated circuit (ASIC), a single circuit, a processor (shared, dedicated, or chipset) and a memory for executing one or more software or firmware programs, a combinational logic circuit, and/or other suitable components that can achieve the above described functions.

The electronic device includes a screen, an application processor (AP), and a bus. The AP is coupled with the bus and includes a distributed processing unit (DPU). The DPU includes hardware of N layers, a layer mix, a display post processing (DSPP), and a display serial interface (DSI). The hardware of N layers includes hardware of a first layer and hardware of M second layer, where N is an integer greater than 1, M is less than N. Each of the hardware of N layers is coupled with the layer mix, the layer mix is coupled with the DSPP, the DSPP is coupled with the DSI, and the DSI is coupled with the screen.

Figure 1:
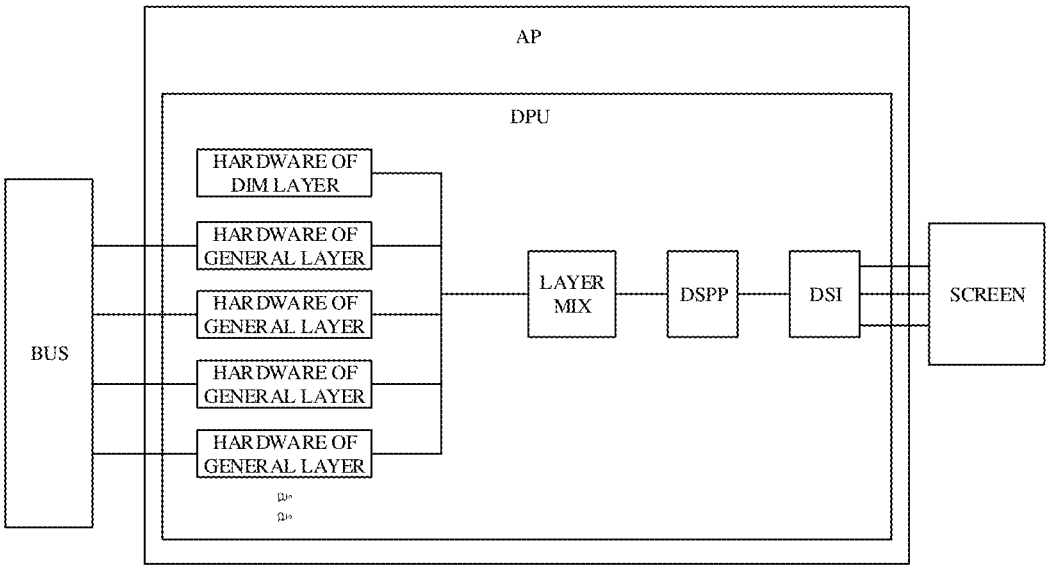
FIG. 1 is a schematic structural diagram illustrating an electronic device according to implementations.

On condition that the hardware of the first layer is hardware of a dim layer, and hardware of the M second layer is hardware of M general layer, a schematic structural diagram of the electronic device can be illustrated as FIG. 1.

Figure 2:
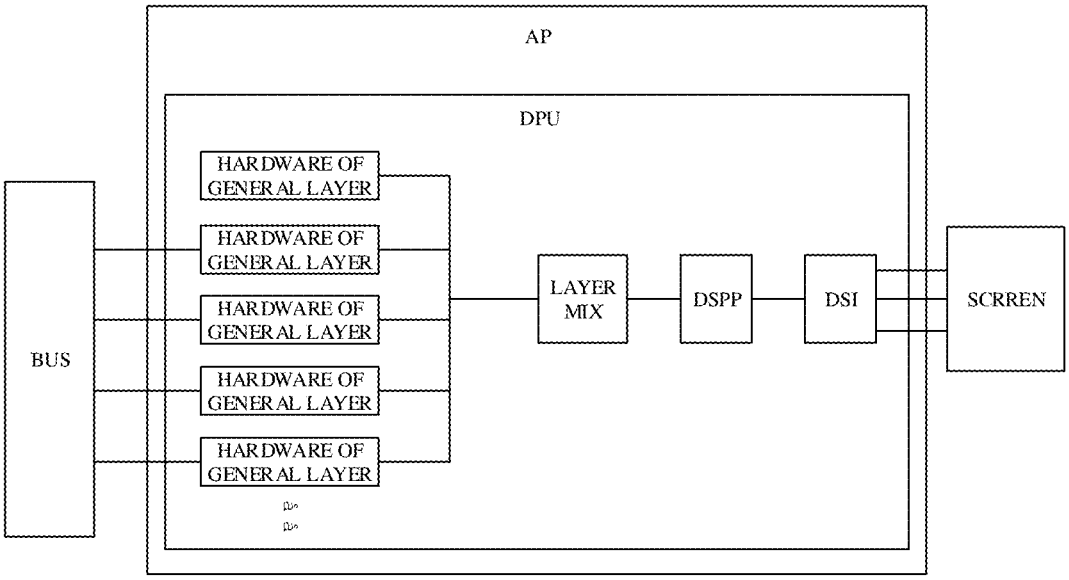
FIG. 2 is a schematic structural diagram illustrating an electronic device according to other implementations.

On condition that all of hardware of layers included in the electronic device is hardware of general layers (that is, both the hardware of the first layer and the hardware of the M second layer are hardware of general layers), a schematic structural diagram of the electronic device can be illustrated as FIG. 2.

The hardware of a general layer is configured to transmit layer information of an associated layer.

The hardware of a dim layer is configured to create a layer and modify a layer parameter of an associated layer as well as transmitting layer information of an associated layer. The hardware of the dim layer includes at least one register, and the at least one register includes at least one of the following: a size register, a shape register, a transparency register, and an RGB register. The dim layer can also be interpreted as a mask or mask layer.

Figure 3:
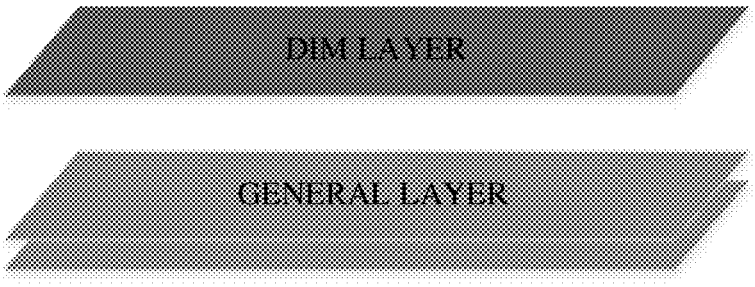
FIG. 3 is a schematic diagram illustrating layers according to implementations.
Figure 4:
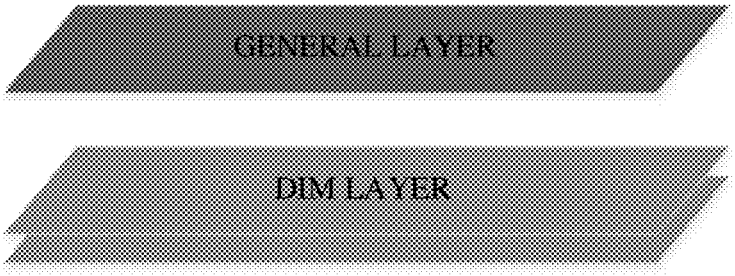
FIG. 4 is a schematic diagram illustrating layers according to other implementations.

Specifically, a picture displayed on the screen that can be seen by a user is obtained by superimposing multiple layers. The multiple layers may include a dim layer and multiple general layers (as illustrated in FIG. 3), or all of the multiple layers are general layers (as illustrated in FIG. 4), which is not limited herein. The multiple general layers can include a status bar layer, a launcher layer, a wallpaper layer, a navigation bar layer, etc.

Hereinafter, the implementations of the disclosure will be interpreted in detail.

Figure 5:
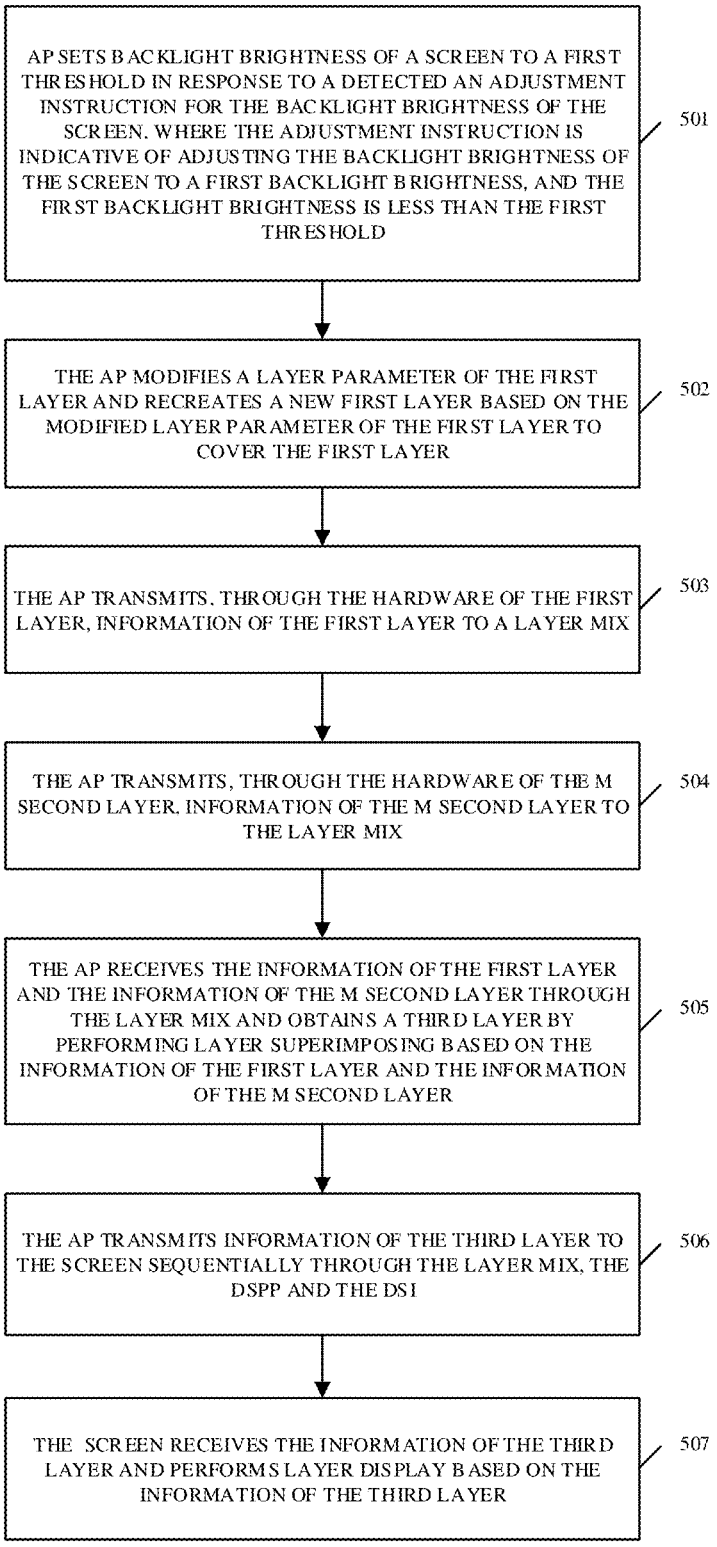
FIG. 5 is a schematic flow chart illustrating a method for display-brightness adjustment according to implementations.

FIG. 5 is a schematic flow chart illustrating a method for display-brightness adjustment according to implementations. The method for display-brightness adjustment is for an electronic device, and as illustrated in FIG. 5, the method includes the following.

At block 501, AP sets backlight brightness of a screen to a first threshold in response to detecting an adjustment instruction for the backlight brightness of the screen. The adjustment instruction is indicative of adjusting the backlight brightness of the screen to a first backlight brightness, and the first backlight brightness is less than the first threshold.

The "in response to detecting an adjustment instruction for the backlight brightness of the screen" can also be understood as "in response to a detected adjustment instruction for the backlight brightness of the screen". The first threshold refers to the lowest backlight brightness that the electronic device can set the screen to. The first threshold may be 256, 260, or other values.

The adjustment instruction may be triggered by adjusting a backlight brightness progress bar by the user, or may be automatically triggered by the electronic device (such as the backlight brightness of the screen is adjusted based on ambient-light brightness), which is not uniquely limited herein.

The AP sets the backlight brightness of the screen to the first threshold by first setting a backlight-brightness parameter of the screen to the first threshold, and then validating the modified backlight-brightness parameter.

At block 502, the AP modifies a layer parameter of the first layer and recreates a new first layer based on the modified layer parameter of the first layer to cover the first layer. The layer parameter of the first layer includes at least one of: a size, a transparency, or a RGB value. A modified RGB value is a constant and less than the RGB value before modification, and a modified transparency is greater than the transparency before modification.

The layer parameter of the first layer may also include a shape. The size included in the layer parameter of the first layer represents a size of the first layer, such as 3 cm*3 cm, 4 cm*3 cm, etc. The shape included in the layer parameter of the first layer represents a shape of the first layer, such as a square, a rectangle, a square with rounded corners, etc. The transparency included in the layer parameter of the first layer represents a transparency of the first layer. The RGB value included in the layer parameter of the first layer represents a RGB value of the first layer.

On condition that the hardware of the first layer is the hardware of the dim layer, the shape of the first layer is determined by the shape of the hardware of the first layer. For example, if the shape of the hardware of the first layer is a square, the shape of the first layer can be a square; if the shape of the hardware of the first layer is a square with rounded corners, the shape of the first layer can be a square with rounded corners.

At block 503, the AP transmits, through the hardware of the first layer, information of the first layer to a layer mix.

At block 504, the AP transmits, through the hardware of the M second layer, information of the M second layer to the layer mix. The information of the M second layer corresponds to the hardware of the M general layer in one-to-one correspondence.

Information of a layer (i.e., the information of the first layer and the information of the M second layer) described herein includes image data of the layer and a layer parameter of the layer. The layer parameter of the layer includes at least one of the following: a rotation angle, a size arranged in a z-order (i.e., vertically aligned), a starting coordinate of an input image, a size of the input image, a starting coordinate of an output image, a size of the output image, and so on.

At block 505, the AP receives the information of the first layer and the information of the M second layer through the layer mix and obtains a third layer by performing layer superimposing based on the information of the first layer and the information of the M second layer through the layer mix.

At block 506, the AP transmits information of the third layer to the screen sequentially through the layer mix, the DSPP and the DSI.

At block 507, the screen receives the information of the third layer and performs layer display based on the information of the third layer.

The backlight brightness of the screen plus content brightness equals the display brightness of the screen that can be seen the user. Reference can be made to FIG. 2, before the dim layer (i.e. the first layer) is modified, for a RGB value of the screen, $R=a\times R0+(1-a)\times R1$, $G=a\times G0+(1-a)-G1$, $B=a\times B0+(1-a)\times B1$, where R0 is the value of R of the first layer, R1 is the value of R of multiple general layers superimposed together, G0 is the value of G of the first layer, G1 is the value of G of multiple general layers superimposed together, B0 is the value of B of the first layer, B1 is the value of B of multiple general layers superimposed together, and a is the transparency of the first layer.

Since the modified RGB value of the first layer is a constant, assuming that the constant is 0, after the dim layer (that is, the first layer) is modified, for a RGB value of the screen, $R=(1-a)\times R1$, $G=(1-a)\times G1$, $B=(1-a)\times B1$. When the modified RGB value of the first layer is 0, that is, the modified value of R0 of the first layer is 0, the modified value of G0 of the first layer is 0, the modified value of B0 of the first layer is 0, it means that the first layer is completely transparent.

Therefore, on condition that the backlight brightness of the screen to be adjusted that is indicated by the adjustment instruction is less than the first threshold, however, the backlight brightness can only be set to the first threshold by the electronic device, if the display brightness of the screen needs to be reduced, the transparency of the first layer can be increased.

In the implementations of the present disclosure, upon detecting the adjustment instruction for indicating adjusting the backlight brightness of the screen to the first backlight brightness and the first backlight brightness is less than the first threshold, the backlight brightness of the screen is set to the first threshold. The layer parameter of the first layer is set, a new first layer is created based on the modified layer parameter of the first layer, and then the new first layer is superimposed with other general layers. A RGB value of the new first layer is a constant, the RGB value of the new first layer is less than a RGB value of the first layer (original first layer), and a transparency of the new first layer is greater than that of the original first layer, thus the display brightness of the screen seen by the user is reduced due to the layer superimposing based on the new first layer, which can avoid an adjustment method by adjusting a duty cycle of power supply and reduce screen flicking.

As an implementation, the hardware of the first layer is hardware of a dim layer, and the AP modifies the layer parameter of the first layer, and recreates the new first layer based on the modified layer parameter of the first layer by modifying, through the hardware of the first layer, the layer parameter of the first layer, and recreating, through the hardware of the first layer, the new first layer based on the modified layer parameter of the first layer The hardware of the first layer includes at least one register, and the at least one register includes at least one of the following: a size register, a shape register, a transparency register, and an RGB register. The AP modifies the layer parameter of the first layer through the hardware of the first layer by modifying, through hardware of the first layer, the value of the at least one register included in the hardware of the first layer. For example, assuming that the layer parameter of the first layer to be modified includes the transparency and the RGB values, the AP modifies the value of the transparency register and the value of the RGB register through the hardware of the first layer.

The hardware of the dim layer can directly modify the layer parameter of the dim layer and directly create a layer, thus the power consumption of the electronic device can be reduced.

As an implementation, the hardware of N layers is hardware of general layers and the AP creates a first layer in an application space, and uses hardware of a first general layer as the hardware of the first layer, before modifying the layer parameter of the first layer, and recreating the new first layer based on the modified layer parameter of the first layer. The AP modifies the layer parameter of the first layer, and recreates the new first layer based on the modified layer parameter of the first layer by modifying the layer parameter of the first layer, and recreating in the application space the new first layer based on the modified layer parameter of the first layer.

The AP includes at least one register associated with the hardware of the first layer, and the at least one register includes at least one of the following: a size register, a shape register, a transparency register, and an RGB register. The AP modifies the layer parameter of the first layer by modifying the value of at least one register associated with the hardware of the first layer. For example, assuming that the layer parameter of the first layer to be modified include the transparency and the RGB value, the AP can directly modify the value of the transparency register and the value of the RGB register associated with the hardware of the first layer.

On condition that the electronic device only has hardware of general layers, a normal layer can be created in the application space, and the normal layer occupies hardware of a general layer, and then the above-mentioned solution about the dim layer can be used, so as to use the hardware of the dim layer even when the electronic device has no dim layer, which improves the performance of the electronic device.

As an implementation, the layer parameter of the first layer includes the size, the AP determines a modified size of the first layer based on an interface currently displayed by the electronic device before modifying the layer parameter of the first layer.

The AP can determine the modified size of the first layer based on the interface currently displayed by the electronic device by obtaining a target size of the interface currently displayed by the electronic device and using the target size as the modified size of the first layer. For example, if the size of the interface currently displayed by the electronic device is 4 cm*4 cm, then the modified size of the first layer is also 4 cm*4 cm.

In the implementations of the present disclosure, the size of the first layer is determined by the interface currently displayed by the electronic device, so as to meet requirements of different application scenarios and further improve the performance of the electronic device.

As an implementation, the layer parameter of the first layer includes the transparency and the AP can further perform the following before modifying the layer parameter of the first layer.

The AP determines a first transparency corresponding to the first backlight brightness according to a mapping relationship between backlight brightness (values) and transparencies, and determines the first transparency as the modified transparency of the first layer.

The mapping relationship between the backlight brightness and the transparencies can be illustrated in Table 1.

TABLE 1

| Backlight brightness (unit: cd/m) | Transparency |
|---|---|
| 250 | 0.4 |
| 200 | 0.3 |
| 150 | 0.2 |
| . . . | . . . |

In the implementations of the present disclosure, the modified transparency of the first layer can be determined directly according to a mapping relationship stored in advance, which improves the speed of determining the transparency and the speed response to brightness adjustment.

As an implementation, the layer parameter of the first layer includes the transparency, before modifying the layer parameter of the first layer, the AP can further determine a second transparency corresponding to the first backlight brightness according to a bilinear interpolation formula, and determine the second transparency as the modified transparency of the first layer.

Specifically, the AP obtains multiple reference backlight brightness (values), and obtains a reference transparency corresponding to each of the multiple reference backlight brightness, to obtain multiple reference transparencies; the AP obtains two reference backlight brightness from the multiple reference backlight brightness and obtains two reference transparencies corresponding to the two reference backlight brightness; then based on the two reference backlight brightness, the two reference transparencies, and the preset bilinear interpolation formula, the AP determines the second transparency corresponding to the first backlight brightness and uses the second transparency as the modified transparency of the first layer.

For example, suppose that the multiple reference backlight brightness and corresponding multiple reference transparencies include (x1, y1) and (x2, y2), where x1 is less than the first backlight brightness, x2 is greater than the first backlight brightness, the second transparency corresponding to the first backlight brightness can be determined based on the following preset bilinear interpolation formula:

$$a=2*(y2-y1)*(x-x1)/(x2-x1);$$

x in the preset bilinear interpolation formula represents the backlight brightness.

As an implementation, the layer parameter of the first layer includes the transparency. Before modifying the layer parameter of the first layer, the AP further determines a third transparency corresponding to the first backlight brightness according to a fitting function, and determines the third transparency as the modified transparency of the first layer.

Specifically, the AP determines the third transparency corresponding to the first backlight brightness according to the fitting function, and determines the third transparency as the modified transparency of the first layer as follows. The AP obtains multiple reference backlight brightness, and obtains a reference transparency corresponding to each of the multiple reference backlight brightness, to obtain multiple reference transparency; the AP performs fitting according to the multiple reference transparencies and the multiple reference backlight brightness to obtain the fitting function which is related to transparencies and backlight brightness; the AP substitutes the first backlight brightness value into the fitting function to obtain the third transparency, and determines the third transparency as the modified transparency of the first layer.

As an implementation, setting the backlight brightness of the screen to the first threshold and operations after setting the backlight brightness of the screen to the first threshold are executed in parallel. The operations after setting the backlight brightness of the screen to the first threshold, i.e., operations of content brightness adjustment, may include: modifying the layer parameter of the first layer, and recreating the new first layer based on the modified layer parameter of the first layer to cover the first layer; receiving, through the layer mix, the information of the first layer and the information of the M second layer and obtaining, through the layer mix, the third layer by performing layer superimposing based on the information of the first layer and the information of the M second layer; receiving, through the screen, the information of the third layer and performing, through the screen, layer display based on the information of the third layer.

In the implementations of the present disclosure, screen backlight-brightness adjustment and content brightness adjustment are performed in parallel, that is, these two actions are executed at the same time, thereby avoiding screen flicking caused by these two actions being out of sync.

As an implementation, the DPU further includes a display layer post processing (DSPP), the DSPP is coupled with the layer mix, and the DSPP includes a dither. The AP receives, through the screen, the information of the third layer and performs, through the screen, layer display based on the information of the third layer as follows.

The AP receives, through the DSPP, the information of the third layer. The AP obtains information of a fourth layer by adding, through the dither, dither noise to the information of the third layer. The AP receives, through the screen, the information of the fourth layer and performs, through the screen, the layer display based on the information of the fourth layer, and the information of the fourth layer being transmitted through the DSPP.

In implementations of the present disclosure, as the display brightness is lowered and a gray scale of a picture decreases, which may result in faults (i.e., banding), dither noise is added through the dither for compensation, thereby solve a banding problem.

The following are device implementations of the present disclosure, and the device implementations of the present disclosure are used to execute the methods implemented in the method implementations of the present disclosure.

Figure 6:
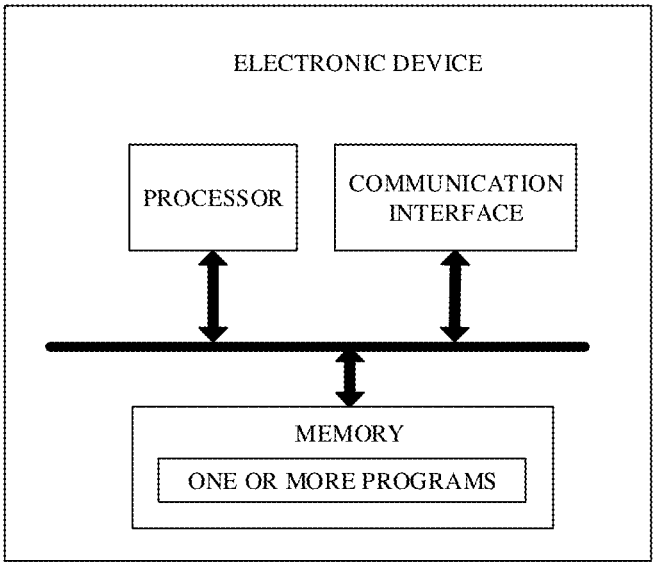
FIG. 6 is a schematic structural diagram illustrating an electronic device according to other implementations.

FIG. 6 is a schematic structural diagram illustrating an electronic device according to other implementations. The electronic device includes a screen and a distributed processing unit (DPU), the DPU includes hardware of N layers and a layer mix, and the hardware of N layers includes hardware of one first layer and hardware of M second layer, where N is an integer greater than 1, M<N, and each of the hardware of N layers is coupled with the layer mix. The electronic device includes a processor, a memory, a communication interface, and one or more programs stored in the memory. The one or more programs are configured to be executed by the processor and include instructions configured to perform the following.

Backlight brightness of the screen is set to a first threshold in response to detecting an adjustment instruction for the backlight brightness of the screen, where the adjustment instruction is indicative of adjusting the backlight brightness of the screen to a first backlight brightness, the first backlight brightness being less than the first threshold. A layer parameter of the first layer is modified and a new first layer is recreated based on the modified layer parameter of the first layer to cover the first layer, where the layer parameter of the first layer includes at least one of: a size, a transparency, or a RGB value, where a modified RGB value is a constant and less than the RGB value before modification, and a modified transparency is greater than the transparency before modification. Information of the first layer and information of the M second layer are received through the layer mix and a third layer is obtained by performing layer superimposing based on the information of the first layer and the information of the M second layer through the layer mix, where the information of first layer is transmitted through the hardware of the first layer, and the information of the M second layer is transmitted through the hardware of the M second layer. Information of the third layer is received through the screen and layer display is performed through the screen based on the information of the third layer, the information of the third layer being transmitted through the layer mix.

As an implementation, the hardware of the first layer is hardware of a dim layer and in terms of modifying the layer parameter of the first layer, and recreating the new first layer based on the modified layer parameter of the first layer, the one or more programs include instructions configured to modify, through the hardware of the first layer, the layer parameter of the first layer, and recreate, through the hardware of the first layer, the new first layer based on the modified layer parameter of the first layer.

As an implementation, the hardware of N layers is hardware of general layers, and the one or more programs further include instructions configured to perform the following. Before the layer parameter of the first layer is modified and the new first layer is recreated based on the modified layer parameter of the first layer, a first layer is created in an application space, and hardware of a first general layer is used as the hardware of the first layer.

In terms of modifying the layer parameter of the first layer, and recreating the new first layer based on the modified layer parameter of the first layer, the one or more programs further include instructions configured to modify the layer parameter of the first layer, and recreate in the application space the new first layer based on the modified layer parameter of the first layer.

As an implementation, the layer parameter of the first layer includes the size, and the one or more programs further include instructions configured to determine a modified size of the first layer based on an interface currently displayed by the electronic device before the layer parameter of the first layer is modified.

As an implementation, the layer parameter of the first layer includes the transparency and the one or more programs further include instructions configured to determine a first transparency corresponding to the first backlight brightness according to a mapping relationship between backlight brightness and transparencies before modifying the layer parameter of the first layer; determine the first transparency as the modified transparency of the first layer.

As an implementation, the layer parameter of the first layer includes the transparency and the one or more programs further include instructions configured to determine a second transparency corresponding to the first backlight brightness according to a bilinear interpolation formula before modifying the layer parameter of the first layer; determine the second transparency as the modified transparency of the first layer.

As an implementation, the layer parameter of the first layer includes the transparency and the one or more programs further include instructions configured to determine a third transparency corresponding to the first backlight brightness according to a fitting function before modifying the layer parameter of the first layer; determine the third transparency as the modified transparency of the first layer.

As an implementation, setting the backlight brightness of the screen to the first threshold and operations after setting the backlight brightness of the screen to the first threshold are executed in parallel.

As an implementation, the DPU further includes a display layer post processing (DSPP), the DSPP is coupled with the layer mix, the DSPP includes a dither, and in terms of receiving, through the screen, the information of the third layer and performing, through the screen, layer display based on the information of the third layer, the one or more programs further include instructions configured to: receive, through the DSPP, the information of the third layer; obtain information of a fourth layer by adding, through the dither, dither noise to the information of the third layer; receive, through the screen, the information of the fourth layer and perform, through the screen the layer, display based on the information of the fourth layer, and the information of the fourth layer being transmitted through the DSPP.

It should be noted that reference of a specific implementation process of the implementations can be made to a specific implementation process described in the foregoing method implementations, which will not be described in detail herein.

In the implementations of the present disclosure, it is to be noted that, the apparatus disclosed in implementations provided herein may be implemented in other manners. For example, the device/apparatus implementations described above are merely illustrative; for instance, the division of the unit is only a logical function division and there can be other manners of division during actual implementations; for example, multiple units or components may be combined or may be integrated into another system, or some features may be ignored, omitted, or not performed. In addition, coupling or communication connection between each illustrated or discussed component may be direct coupling or communication connection, may be indirect coupling or communication among devices or units via some interfaces, and may be electrical connection, mechanical connection, or other forms of connection.

According to the implementations of the disclosure, functional units may be divided for the electronic device in accordance with the foregoing method examples. For example, each functional unit may be divided according to each function, and two or more functions may be integrated in one processing unit. The above-mentioned integrated unit can be implemented in the form of hardware or software functional units. It should be noted that the division of units in the embodiments of the present disclosure is schematic, and is merely a logical function division, and there may be other division manners in actual implementation.

Figure 7:
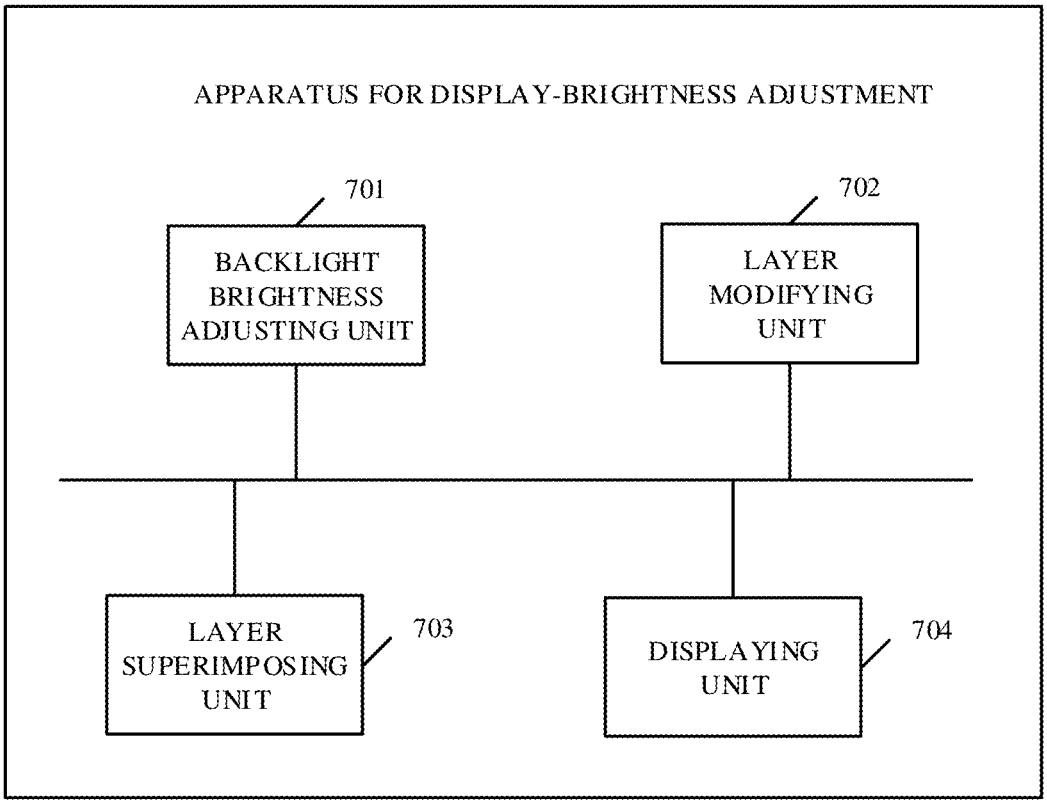
FIG. 7 is a schematic structural diagram illustrating an apparatus for display-brightness adjustment according to implementations.

FIG. 7 is a schematic structural diagram illustrating an apparatus for display-brightness adjustment according to implementations. The apparatus for display-brightness adjustment is for an electronic device including a screen and a distributed processing unit (DPU). The DPU includes hardware of N layers and a layer mix, the hardware of N layers includes hardware of a first layer and hardware of M second layer, N is an integer greater than 1, M<N, and each of the hardware of N layers is coupled with the layer mix. The apparatus a backlight brightness adjusting unit 701, a layer modifying unit 702, a layer superimposing unit 703, and a displaying unit 704.

The backlight brightness adjusting unit 701 is configured to set backlight brightness of the screen to a first threshold in response to detecting an adjustment instruction for the backlight brightness of the screen, where the adjustment instruction is indicative of adjusting the backlight brightness of the screen to a first backlight brightness, the first backlight brightness is less than the first threshold.

The layer modifying unit 702 is configured to modify a layer parameter of the first layer, and recreate a new first layer based on the modified layer parameter of the first layer to cover the first layer, where the layer parameter of the first layer includes at least one of: a size, a transparency, or a RGB value, where a modified RGB value is a constant and less than the RGB value before modification, and a modified transparency is greater than the transparency before modification.

The layer superimposing unit 703 is configured to receive, through the layer mix, information of the first layer and information of the M second layer and obtain, through the layer mix, a third layer by performing layer superimposing based on the information of the first layer and the information of the M second layer, where the information of first layer is transmitted through the hardware of the first layer, and the information of the M second layer is transmitted through the hardware of the M second layer.

The displaying unit 704 is configured to receive, through the screen, information of the third layer and perform layer display through the screen based on the information of the third layer, the information of the third layer being transmitted through the layer mix.

As an implementation, the hardware of the first layer is hardware of a dim layer and the layer modifying unit 702 configured to modify the layer parameter of the first layer, and recreate the new first layer based on the modified layer parameter of the first layer is configured to: modify, through the hardware of the first layer, the layer parameter of the first layer, and recreating, through the hardware of the first layer, the new first layer based on the modified layer parameter of the first layer.

As an implementation, the hardware of N layers is hardware of general layers and the layer modifying unit 702 is further configured to create a first layer in an application space, and use hardware of a first general layer as the hardware of the first layer before modifying the layer parameter of the first layer and recreating the new first layer based on the modified layer parameter of the first layer. The layer modifying unit 702 configured to modify the layer parameter of the first layer, and recreate the new first layer based on the modified layer parameter of the first layer is configured to modify the layer parameter of the first layer, and recreate in the application space the new first layer based on the modified layer parameter of the first layer.

As an implementation, the layer parameter of the first layer includes the size and the layer modifying unit 702 is further configured to determine a modified size of the first layer based on an interface currently displayed by the electronic device before modifying the layer parameter of the first layer.

As an implementation, the layer parameter of the first layer includes the transparency and the layer modifying unit 702 is further configured to determine a first transparency corresponding to the first backlight brightness according to a mapping relationship between backlight brightness and transparencies before modifying the layer parameter of the first layer; determine the first transparency as the modified transparency of the first layer.

As an implementation, the layer parameter of the first layer includes the transparency and the layer modifying unit 702 is further configured to determine a second transparency corresponding to the first backlight brightness according to a bilinear interpolation formula before modifying the layer parameter of the first layer; determine the second transparency as the modified transparency of the first layer.

As an implementation, the layer parameter of the first layer includes the transparency and the layer modifying unit 702 is further configured to determine a third transparency corresponding to the first backlight brightness according to a fitting function before modifying the layer parameter of the first layer; determine the third transparency as the modified transparency of the first layer.

As an implementation, setting the backlight brightness of the screen to the first threshold and operations after setting the backlight brightness of the screen to the first threshold are executed in parallel.

As an implementation, the DPU further includes a display layer post processing (DSPP), the DSPP is coupled with the layer mix, the DSPP includes a dither, and the displaying unit 704 configured to receive, through the screen, the information of the third layer and perform layer display through the screen based on the information of the third layer is configured to receive, through the DSPP, the information of the third layer, obtain information of a fourth layer by adding, through the dither, dither noise to the information of the third layer, receive, through the screen, the information of the fourth layer, and perform the layer display through the screen based on the information of the fourth layer, and the information of the fourth layer being transmitted through the DSPP.

The backlight brightness adjusting unit 701, the layer modifying unit 702, the layer superimposing unit 703, and the displaying unit 704 may be implemented by a processor.

A non-transitory computer storage medium is also provided. The non-transitory computer storage medium is configured to store programs which, when executed, are operable to execute some or all of the steps of any of the methods for display-brightness adjustment as described in the above-described method implementations. The computer may include an electronic device.

A computer program product is also provided. The computer program product includes a non-transitory computer-readable storage medium that stores computer programs. The computer programs are operable with a computer to execute some or all operations of the method display-brightness adjustment as described in the above-described method implementations. The computer program product may be a software installation package. The computer may include an electronic device.

It is to be noted that, for the sake of simplicity, the foregoing method implementations are described as a series of action combinations. However, it will be appreciated by those skilled in the art that the present disclosure is not limited by the sequence of actions described. According to the present disclosure, certain steps or operations may be performed in other order or simultaneously. Besides, it will be appreciated by those skilled in the art that the implementations described in the specification are exemplary implementations and the actions and modules involved are not necessarily essential to the present disclosure.

In the foregoing implementations, the description of each implementation has its own emphasis. For the parts not described in detail in an implementation, reference may be made to related descriptions in other implementations.

In the implementations of the present disclosure, it is to be noted that, the apparatus disclosed in implementations provided herein may be implemented in other manners. For example, the device/apparatus implementations described above are merely illustrative; for instance, the division of the unit is only a logical function division and there can be other manners of division during actual implementations; for example, multiple units or components may be combined or may be integrated into another system, or some features may be ignored, omitted, or not performed. In addition, coupling or communication connection between each illustrated or discussed component may be direct coupling or communication connection, may be indirect coupling or communication among devices or units via some interfaces, and may be electrical connection, mechanical connection, or other forms of connection.

The units described as separate components may or may not be physically separated, and the components illustrated as units may or may not be physical units, that is, they may be in the same place or may be distributed to multiple network elements. All or part of the units may be selected according to actual needs to achieve the purpose of the technical solutions of the implementations.

In addition, the functional units in various implementations of the present disclosure may be integrated into one processing unit, or each unit may be physically present, or two or more units may be integrated into one unit. The above-mentioned integrated unit can be implemented in the form of hardware or a software function unit.

The integrated unit may be stored in a computer-readable memory when it is implemented in the form of a software functional unit and is sold or used as a separate product. Based on such understanding, the technical solutions of the present disclosure essentially, or the part of the technical solutions that contributes to the related art, or all or part of the technical solutions, may be embodied in the form of a software product which is stored in a memory and includes instructions for causing a computer device (which may be a personal computer, a server, or a network device, and so on) to perform all or part of the steps described in the various implementations of the present disclosure. The memory includes various medium capable of storing program codes, such as a USB (universal serial bus) flash disk, a read-only memory (ROM), a random access memory (RAM), a removable hard disk, Disk, compact disc (CD), or the like.

It will be noted by those of ordinary skill in the art that all or a part of the various methods of the implementations described above may be accomplished by means of a program to instruct associated hardware, where the program may be stored in a computer-readable memory, which may include a flash memory, a read-only memory (ROM), a random-access memory (RAM), a disk or a compact disc (CD), and so on.

The implementations of the present disclosure are described in detail above, specific examples are used herein to describe the principle and implementation manners of the present disclosure. The description of the above implementations is merely used to help understand the method and the core idea of the present disclosure. Meanwhile, those skilled in the art may make modifications to the specific implementation manners and the application scope according to the idea of the present disclosure. In summary, the contents of the specification should not be construed as limiting the present disclosure.

What is claimed is:

1. A method for display-brightness adjustment, for an electronic device comprising a screen and a distributed processing unit (DPU), the DPU comprising hardware of N layers and a layer mix, the hardware of N layers comprising hardware of a first layer and hardware of M second layer, N being an integer greater than 1, M<N, each of the hardware of N layers being coupled with the layer mix, and the method comprising:

setting backlight brightness of the screen to a first threshold in response to detecting an adjustment instruction for the backlight brightness of the screen, wherein the adjustment instruction is indicative of adjusting the backlight brightness of the screen to a first backlight brightness, the first backlight brightness being less than the first threshold;

modifying a layer parameter of the first layer, and recreating a new first layer based on the modified layer parameter of the first layer to cover the first layer, wherein the layer parameter of the first layer comprises at least one of: a size, a transparency, or a RGB value, wherein a modified RGB value is a constant and less than the RGB value before modification, and a modified transparency is greater than the transparency before modification;

receiving information of the first layer and information of the M second layer through the layer mix and obtaining a third layer by performing layer superimposing based on the information of the first layer and the information of the M second layer through the layer mix, wherein the information of the first layer is transmitted through the hardware of the first layer, and the information of the M second layer is transmitted through the hardware of the M second layer; and receiving information of the third layer through the screen and performing layer display through the screen based on the information of the third layer, the information of the third layer being transmitted through the layer mix;

wherein the layer parameter of the first layer comprises the transparency, and the method further comprises:

before modifying the layer parameter of the first layer:

determining a transparency corresponding to the first backlight brightness according to a bilinear interpolation formula; and determining the transparency as the modified transparency of the first layer.

2. The method of claim 1, wherein the hardware of the first layer is hardware of a dim layer and modifying the layer parameter of the first layer, and recreating the new first layer based on the modified layer parameter of the first layer comprises:

modifying the layer parameter of the first layer through the hardware of the first layer, and recreating the new first layer based on the modified layer parameter of the first layer through the hardware of the first layer.

3. The method of claim 1, wherein the hardware of N layers is hardware of general layers and the method comprises:

before modifying the layer parameter of the first layer, and recreating the new first layer based on the modified layer parameter of the first layer:

creating a first layer in an application space, and using hardware of a first general layer as the hardware of the first layer; and wherein modifying the layer parameter of the first layer, and recreating the new first layer based on the modified layer parameter of the first layer comprises:

modifying the layer parameter of the first layer, and recreating in the application space the new first layer based on the modified layer parameter of the first layer.

4. The method of claim 1, wherein setting the backlight brightness of the screen to the first threshold and operations after setting the backlight brightness of the screen to the first threshold are executed in parallel.

5. The method of claim 1, wherein the DPU further comprises a display layer post processing (DSPP), the DSPP is coupled with the layer mix, the DSPP comprises a dither, and receiving the information of the third layer through the screen and performing layer display through the screen based on the information of the third layer comprises:

receiving, through the DSPP, the information of the third layer;

obtaining information of a fourth layer by adding, through the dither, dither noise to the information of the third layer; and receiving the information of the fourth layer through the screen and performing the layer display through the screen based on the information of the fourth layer, and the information of the fourth layer being transmitted through the DSPP.

6. An electronic device comprising a screen, an application processor (AP), a memory, a communication interface, and one or more programs stored in the memory, the AP comprising a distributed processing unit (DPU), the DPU comprising hardware of N layers and a layer mix, the hardware of N layers comprising hardware of a first layer and hardware of M second layer, N being an integer greater than 1, M<N, each of the hardware of N layers being coupled with the layer mix, wherein the one or more programs are configured to be executed by the AP and comprise instructions configured to perform:

setting backlight brightness of the screen to a first threshold in response to detecting an adjustment instruction for the backlight brightness of the screen, wherein the adjustment instruction is indicative of adjusting the backlight brightness of the screen to a first backlight brightness, the first backlight brightness being less than the first threshold;

modifying a layer parameter of the first layer, and recreating a new first layer based on the modified layer parameter of the first layer to cover the first layer, wherein the layer parameter of the first layer comprises at least one of: a size, a transparency, or a RGB value, wherein a modified RGB value is a constant and less than the RGB value before modification, and a modified transparency is greater than the transparency before modification;

receiving information of the first layer and information of the M second layer and obtaining a third layer by performing layer superimposing based on the information of the first layer and the information of the M second layer through the layer mix, wherein the information of the first layer is transmitted through the hardware of the first layer, and the information of the M second layer is transmitted through the hardware of the M second layer; and receiving information of the third layer through the screen and performing layer display through the screen based on the information of the third layer, the information of the third layer being transmitted through the layer mix;

wherein the layer parameter of the first layer comprises the transparency and the one or more programs further comprise instructions configured to perform:

before modifying the layer parameter of the first layer:

determining a transparency corresponding to the first backlight brightness according to a fitting function; and determining the transparency as the modified transparency of the first layer.

7. The electronic device of claim 6, wherein the hardware of the first layer is hardware of a dim layer and in terms of modifying the layer parameter of the first layer, and recreating the new first layer based on the modified layer parameter of the first layer, the one or more programs comprise instructions configured to perform:

modifying, through the hardware of the first layer, the layer parameter of the first layer, and recreating, through the hardware of the first layer, the new first layer based on the modified layer parameter of the first layer.

8. The electronic device of claim 6, wherein the hardware of N layers is hardware of general layers and the one or more programs further comprise instructions configured to perform:

before modifying the layer parameter of the first layer, and recreating the new first layer based on the modified layer parameter of the first layer:

creating a first layer in an application space, and using hardware of a first general layer as the hardware of the first layer; and wherein in terms of modifying the layer parameter of the first layer, and recreating the new first layer based on the modified layer parameter of the first layer, the one or more programs comprise instructions configured to perform:

modifying the layer parameter of the first layer, and recreating in the application space the new first layer based on the modified layer parameter of the first layer.

9. The electronic device of claim 6, wherein setting the backlight brightness of the screen to the first threshold and operations after setting the backlight brightness of the screen to the first threshold are executed in parallel.

10. The electronic device of claim 6, wherein the DPU further comprises a display layer post processing (DSPP), the DSPP is coupled with the layer mix, the DSPP comprises a dither, and in terms of receiving the information of the third layer through the screen and performing layer display through the screen based on the information of the third layer, the one or more programs comprise instructions configured to perform:

receiving, through the DSPP, the information of the third layer;

obtaining information of a fourth layer by adding, through the dither, dither noise to the information of the third layer; and receiving the information of the fourth layer through the screen and performing the layer display through the screen based on the information of the fourth layer, and the information of the fourth layer being transmitted through the DSPP.

11. A non-transitory computer-readable storage medium storing a computer program for electronic data interchange, wherein the computer program causes a computer to execute:

setting backlight brightness of a screen to a first threshold in response to detecting an adjustment instruction for the backlight brightness of the screen, wherein the adjustment instruction is indicative of adjusting the backlight brightness of the screen to a first backlight brightness, the first backlight brightness being less than the first threshold;

modifying a layer parameter of a first layer, and recreating a new first layer based on the modified layer parameter of the first layer to cover the first layer, wherein the layer parameter of the first layer comprises at least one of: a size, a transparency, or a RGB value, wherein a modified RGB value is a constant and less than the RGB value before modification, and a modified transparency is greater than the transparency before modification;

receiving information of the first layer and information of M second layer and obtaining a third layer by performing layer superimposing based on the information of the first layer and the information of the M second layer; and receiving information of the third layer and performing layer display based on the information of the third layer, the information of the third layer being transmitted through a layer mix of a distributed processing unit (DPU), comprising:

receiving, through a display layer post processing (DSPP) of the DPU, the information of the third layer, the DSPP being coupled with the layer mix;

obtaining information of a fourth layer by adding, through a dither of the DSPP, dither noise to the information of the third layer; and receiving the information of the fourth layer through a screen and performing the layer display through the screen based on the information of the fourth layer, and the information of the fourth layer being transmitted through the DSPP.

12. The non-transitory computer-readable storage medium of claim 11, wherein setting the backlight brightness of the screen to the first threshold and operations after setting the backlight brightness of the screen to the first threshold are executed in parallel.

13. The non-transitory computer-readable storage medium of claim 11, wherein hardware of the first layer is hardware of a dim layer and in terms of modifying the layer parameter of the first layer, and recreating the new first layer based on the modified layer parameter of the first layer, the computer program causes the electronic device to execute:

modifying, through the hardware of the first layer, the layer parameter of the first layer, and recreating, through the hardware of the first layer, the new first layer based on the modified layer parameter of the first layer.

14. The non-transitory computer-readable storage medium of claim 11, wherein the computer program further causes the electronic device to execute:

before modifying the layer parameter of the first layer, and recreating the new first layer based on the modified layer parameter of the first layer:

creating a first layer in an application space, and using hardware of a first general layer as hardware of the first layer; and wherein in terms of modifying the layer parameter of the first layer, and recreating the new first layer based on the modified layer parameter of the first layer, the one or more programs comprise instructions configured to perform:

modifying the layer parameter of the first layer, and recreating in the application space the new first layer based on the modified layer parameter of the first layer.

15. The non-transitory computer-readable storage medium of claim 11, wherein the layer parameter of the first layer comprises the size and the computer program further causes the electronic device to execute:

before modifying the layer parameter of the first layer:

determining a modified size of the first layer based on a displayed interface.

16. The non-transitory computer-readable storage medium of claim 11, wherein the layer parameter of the first layer comprises the transparency and the computer program further causes the electronic device to execute:

before modifying the layer parameter of the first layer:

determining a first transparency corresponding to the first backlight brightness according to a mapping relationship between backlight brightness and transparencies; and determining the first transparency as the modified transparency of the first layer.

17. The non-transitory computer-readable storage medium of claim 11, wherein the layer parameter of the first layer comprises the transparency and the computer program further causes the electronic device to execute:

before modifying the layer parameter of the first layer:

determining a second transparency corresponding to the first backlight brightness according to a bilinear interpolation formula; and determining the second transparency as the modified transparency of the first layer.

18. The non-transitory computer-readable storage medium of claim 11, wherein the layer parameter of the first layer comprises the transparency and the computer program further causes the electronic device to execute:

before modifying the layer parameter of the first layer:

determining a third transparency corresponding to the first backlight brightness according to a fitting function; and determining the third transparency as the modified transparency of the first layer.

* * * * *